US006902294B2

(12) United States Patent
Wright

(10) Patent No.: US 6,902,294 B2
(45) Date of Patent: Jun. 7, 2005

(54) LIGHT STAND

(76) Inventor: Michael N. Wright, 1380 E. Hyde Park Blvd., Chicago, IL (US) 60615

( * ) Notice: Subject to any disclaimer, the term of this patent is extended or adjusted under 35 U.S.C. 154(b) by 0 days.

(21) Appl. No.: 10/639,619

(22) Filed: Aug. 13, 2003

(65) Prior Publication Data

US 2005/0036308 A1 Feb. 17, 2005

(51) Int. Cl.[7] ..... F21L 4/00
(52) U.S. Cl. ..... 362/191; 362/432
(58) Field of Search ..... 362/190, 191, 362/285, 382, 418, 432; 248/125.8, 130, 161, 176.1, 177.1

(56) References Cited

U.S. PATENT DOCUMENTS 2,591,888 A * 4/1952 Steffen ..... 362/191
3,187,170 A 6/1965 Kille
4,218,107 A 8/1980 Wilson
4,550,968 A 11/1985 Corrigan
4,962,347 A * 10/1990 Burroughs et al. ..... 362/208
5,319,365 A * 6/1994 Hillinger ..... 362/191
5,630,660 A * 5/1997 Chen ..... 362/190
6,454,228 B1 9/2002 Bosnakovic

* cited by examiner

*Primary Examiner*—Y. My Quach-Lee
(74) *Attorney, Agent, or Firm*—Richard C. Litman

(57) ABSTRACT

The light stand is a tripod for supporting photographic lighting accessories, the light stand being adapted for receiving a replaceable battery power source. A telescoping vertical support post having plurality of extendable, downwardly extending collapsible legs has a battery-mounting fixture, for receiving a conventional rechargeable battery power source, mounted at the bottom of the telescoping vertical support post. An attached battery pack functions as a stabilizing ballast. An accessory-mounting fixture for receiving a photographic lighting accessory, camera, or other device, is disposed at the top of the light stand. A wiring harness extends from the battery-mounting fixture at the bottom to the accessory-mounting fixture at the top, and includes a voltmeter to indicate the voltage or remaining charge of an attached battery pack.

6 Claims, 8 Drawing Sheets

LIGHT STAND

BACKGROUND OF THE INVENTION

1. Field of the Invention

The present invention relates to photographic accessory equipment, and more specifically to a light stand for supporting photographic lighting equipment.

2. Description of the Related Art

Portable light stands and tripods are well known and widely used for a variety of purposes, and in particular for photographic purposes. Most photographers have used a tripod to support a camera for added stability, and many use tripods as lighting stands, mounting strobes and other lighting accessories atop the tripod. Professional photographers rely on durable and heavy-duty equipment to do their jobs.

Video and cinema photographers in particular require powerful lighting that, unlike the strobe lights used for still photography, must light a scene continuously during filming. Lamps for video and cinematic lighting are generally relatively heavy and require substantial electrical power for continuous operation. Outside of a studio, the availability of lighting can become a limiting factor in successfully filming a scene.

Television news video crews exemplify the need for a portable lighting source, and especially for a portable source of power for the lighting. Television news video crews often rely on a truck to carry video equipment, including lighting, to the site of a remote news story or live interview. While the truck can be outfitted with a generator or other power source to power lights, the video crew is often limited by the length of power cords in their ability to reach a remote site.

Portable battery packs can be employed, but become additional and separate pieces of equipment to be carried. Additionally, lighting equipment must be adapted for use with such batteries. Most battery packs used in the video and cinematographic industry are intended for use with video cameras, adapted for use with quick-mount battery adapters found on cameras and not for the connectors used by most lighting accessories.

Various portable photographic lighting stands and fixtures have been attempted and employed, but none heretofore have provided an adequate solution for remote video and cinematographic situations.

U.S. Pat. No. 6,454,228, issued on Sep. 24, 2002 to F. Bosnakovic, discloses a portable vertical support having a self-contained battery. Used for supporting photographic equipment, and in particular a photographic light, the portable vertical support has batteries contained within a hollow center of a center, upright post. This arrangement limits the ability to quickly change batteries once the batteries in use lose their charge. Additionally, the arrangement lacks the convenience of compatibility with rechargeable battery packs that are already in common use in the video and cinematography industry. Finally, no provision is made for an indication of the remaining battery life or charge.

U.S. Pat. No. 3,187,170, issued on Jun. 1, 1965 to L. Kille, discloses an electronic flash apparatus. The apparatus includes a housing containing batteries and other electronics, and a telescoping mast supporting a photographic flash or strobe type light source. Wiring connecting the batteries to the light source is coiled around the mast. The electronic flash apparatus, however, has no provision for a quick-mount battery pack. Additionally, the arrangement lacks the convenience of compatibility with rechargeable battery packs that are already in common use in the video and cinematography industry. Finally, no provision is made for an indication of the remaining battery life or charge.

None of the above inventions and patents, taken either singly or in combination, is seen to describe the instant invention as claimed. Thus a light stand solving the aforementioned problems is desired.

SUMMARY OF THE INVENTION

The light stand of the present invention is a tripod for supporting photographic lighting accessories, the light stand being adapted for receiving a replaceable battery power source.

The light stand has a telescoping vertical support post, and a plurality of extendable, downwardly extending collapsible legs. At the bottom end of the center post is a battery-mounting fixture for receiving a conventional rechargeable battery power source. Because the battery power supply is located at the bottom of the center post, it provides a stabilizing ballast, reducing the tendency of the light stand to be tipped or knocked over.

At the top of the light stand is an accessory-mounting fixture for receiving a photographic lighting accessory, camera, or other device. The light stand includes a wiring harness extending from the battery-mounting fixture at the bottom to the accessory-mounting fixture at the top. A voltmeter is included in the wiring harness to indicate the voltage of a battery that is attached, or to indicate the state of charge of the battery. Connectors on each end of the wiring harness allow for quick and easy replacement of a battery power supply, and of a photographic lighting accessory, camera, or other device.

The battery-mounting fixture itself may be removed entirely from the lighting stand, and includes an accessory-mounting fixture. This allows the battery-mounting fixture to be used as an accessory support and power supply, which is useful, for example, to place a video lighting accessory on a shelf or in another location where a tripod is not suitable.

Accordingly, it is a principal object of the invention to provide a lighting stand with a self-contained, removable battery power supply.

It is another object of the invention to provide a lighting stand with a self-contained, removable battery power supply that is resistant to tipping or being knocked over.

It is a further object of the invention to provide a lighting stand with a self-contained, removable battery power supply that is easily interchangeable.

Still another object of the invention is to provide a lighting stand with a self-contained, removable battery power supply that can be used separately from the lighting stand to support a lighting or other accessory.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
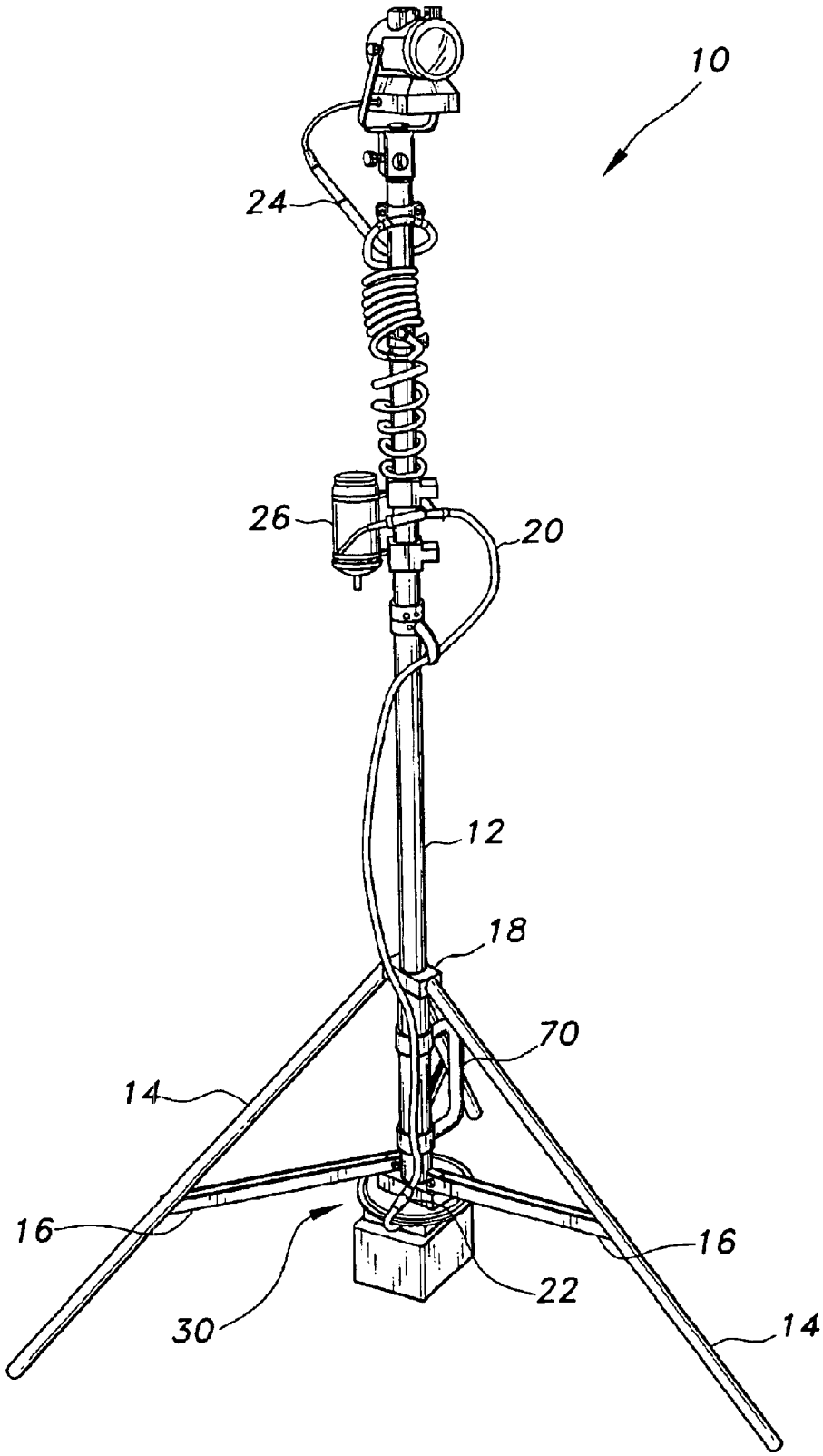
FIG. 1 is an environmental, perspective view of a light stand according to the present invention.

The present invention is a light stand, designated generally as 10 in the drawings.

Figure 2:
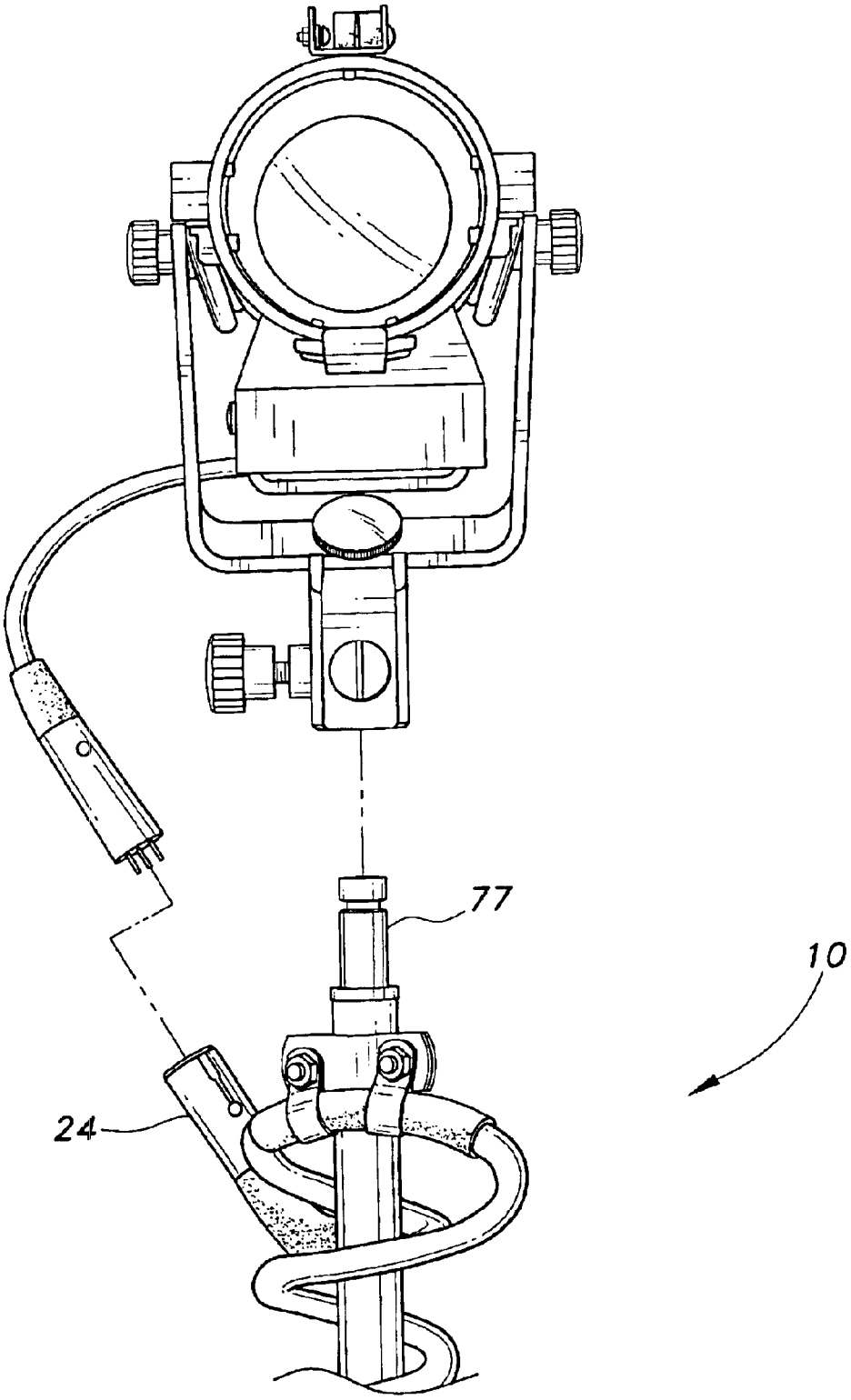
FIG. 2 is a front elevational view of the top of a light stand according to the present invention.

The light stand 10 is generally a conventional tripod structure having a telescoping vertical support post 12 with a plurality of collapsible legs 14 that can be extended and retracted. The collapsible legs 14, and leg supports 16, are disposed on the telescoping vertical support post 12 in a well-known configuration. A handle 70 is disposed along the telescoping vertical support post 12, and may be fixed or slidable in position for good balance when carrying the light stand 10. An accessory-mounting fixture 77, such as a post or "spud" commonly used for mounting photographic lighting accessories, is disposed on the top end of the telescoping vertical support post 12 as seen in FIG. 2.

Figure 3:
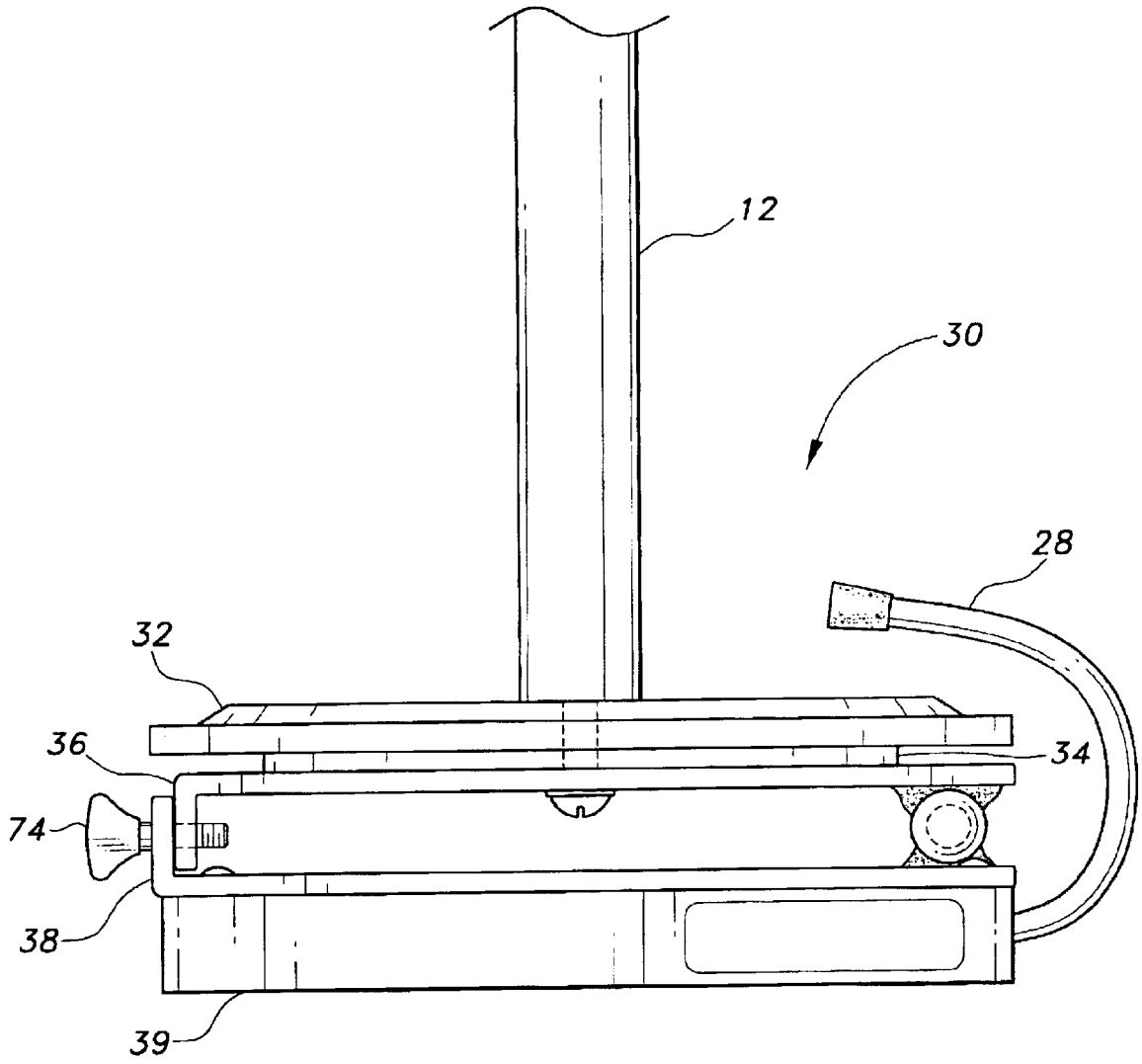
FIG. 3 is a side elevational view of a battery-mounting fixture of the present invention.

Turning now to FIG. 3, a battery-mounting fixture 30 is disposed on the bottom end of the telescoping vertical support post 12. The battery-mounting fixture 30 is comprised generally of a bracket assembly having an upper bracket member 36 and a lower bracket member 38. The upper bracket member 36 is attached to the bottom of the telescoping vertical support post 12. A stabilizing plate 32 is disposed between the upper bracket member 36 and the telescoping vertical support post 12, and an insulating piece 34 of plastic, rubber, or another insulating material, is disposed between the stabilizing plate 32 and the upper bracket member 36.

Figure 4A:
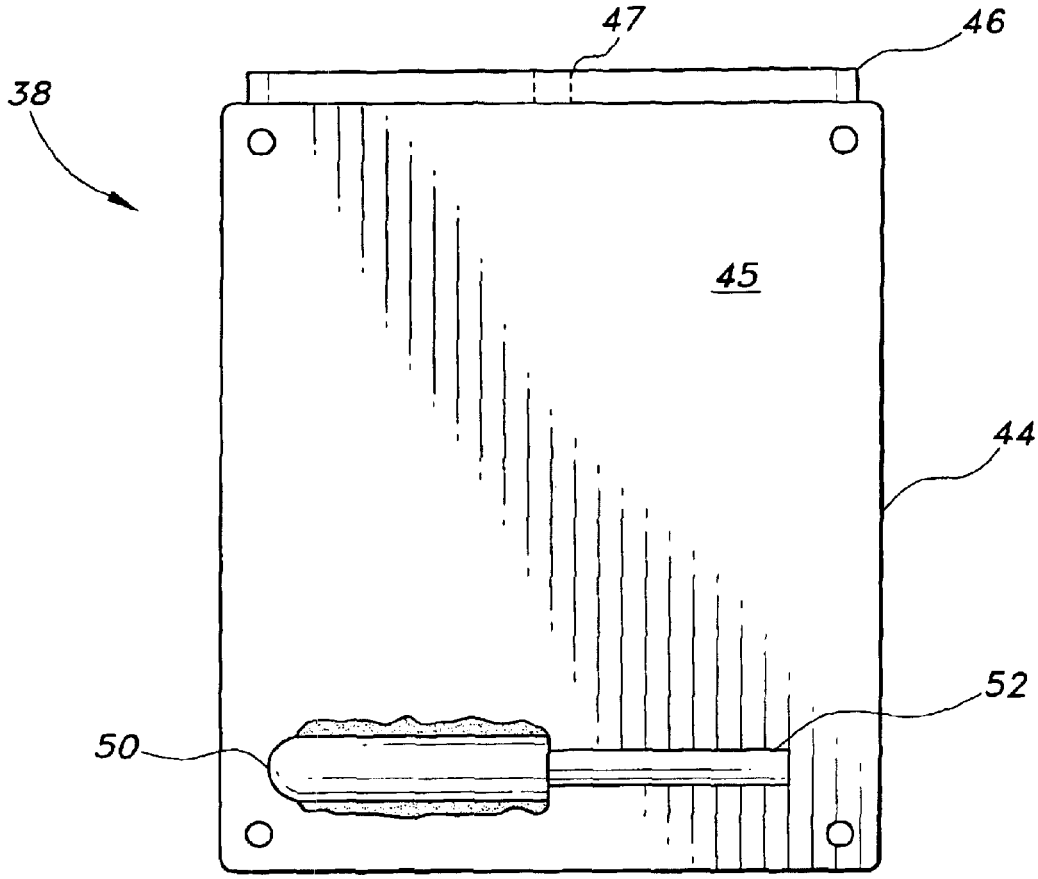
FIG. 4A is a top view of the lower bracket member of the light stand according to the present invention.
Figure 4B:
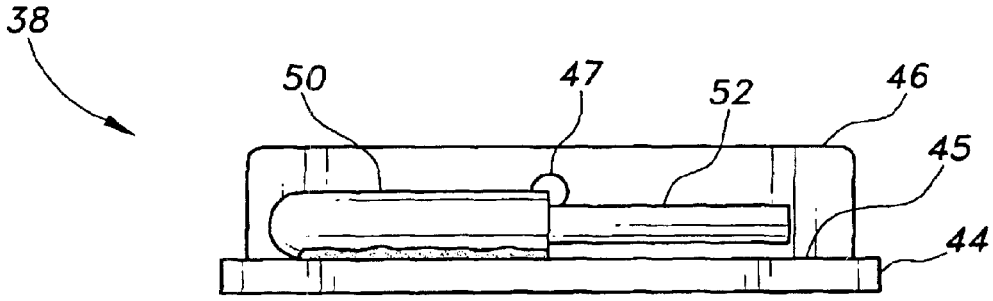
FIG. 4B is a front view of the lower bracket member of the light stand according to the present invention.

The lower bracket member 38, seen in FIGS. 4A and 4B, comprises a generally flat, rectangular plate 44. A hinge body 50, having a hinge pin 52 extending therefrom, is disposed on the top surface 45 of the rectangular plate 44, along an edge of the rectangular plate 44. A vertical edge 46 is disposed on an edge of the rectangular plate 44 opposite the hinge body 50, extending perpendicularly from the top surface 45 of the rectangular plate 44.

Figure 5A:
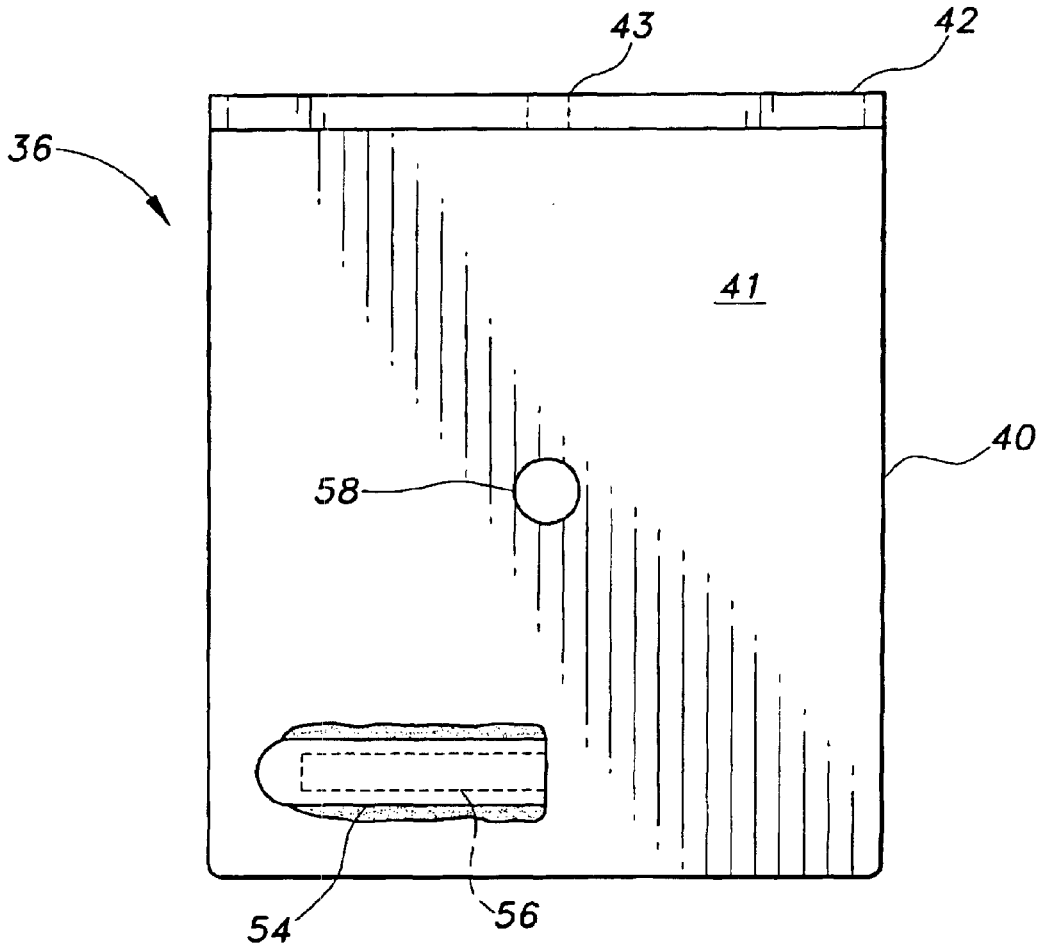
FIG. 5A is a bottom view of the upper bracket member of the light stand according to the present invention.
Figure 5B:
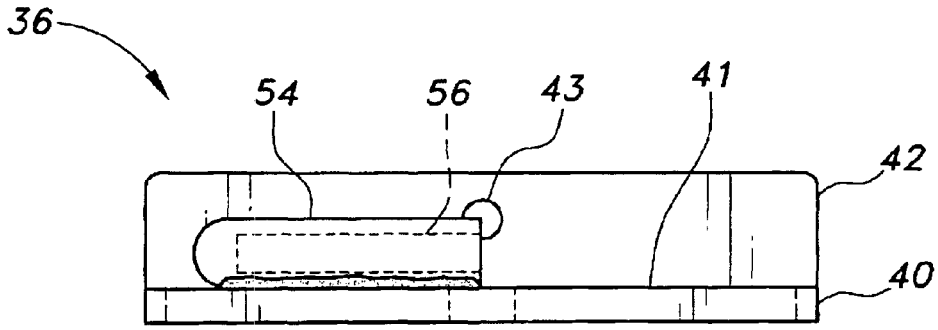
FIG. 5B is a front view of the upper bracket member of the light stand according to the present invention, shown upside-down.

The upper bracket member 36, seen in FIGS. 5A and 5B, comprises a generally flat, rectangular plate 40. A hinge body 54, having a hinge bore 56 formed therein for receiving hinge pin 52, is disposed on the bottom surface 41 of the rectangular plate 40, along an edge of the rectangular plate 40. A vertical edge 42 is disposed on an edge of the rectangular plate 40 opposite the hinge body 54, extending perpendicularly from the bottom surface 41 of the rectangular plate 40. An aperture 58 is formed generally in the center of the rectangular plate 40 to facilitate mounting the upper bracket member 36 to the bottom end of the telescoping vertical support post 12.

The upper bracket member 36 and the lower bracket member 38 are hingeably joined together, with the hinge pin 52 engaged within the hinge bore 56, having the top surface 45 of the lower bracket member 38 facing the bottom surface 41 of the upper bracket member. In a closed position, as seen in FIG. 3, the vertical edge 42 of the upper bracket member 36 comes into alignment with the vertical edge 46 of the lower bracket member 38. A fastener 74, disposed through apertures 43 and 47, holds the bracket members 36, 38 closed.

It can now be seen that, by removing the fastener 74 and disengaging the hinge pin 52 from the hinge bore 56, the lower bracket member 38 can be readily removed from the upper bracket member 36, disengaging the lower bracket member 38 entirely from the light stand 10.

As seen in FIG. 3, a battery adapter 39 is mounted on a bottom surface of the lower bracket member 44. The battery adapter 39 is any commercially available battery adapter or mounting plate suitable for mating with a matching commercially available rechargeable battery pack. Such conventional battery adapters are typically adapted both for quickly releasable mechanical connection and electrical connection, allowing a battery pack to be quickly installed or removed. The "QR-GOLD" Gold Mount Battery Plate Universal Mounting Plate, manufactured by Anton/Bauer, is exemplary. Also see U.S. Pat. Nos. 4,218,107 and 4,550,968, incorporated herein by reference. A battery wire 28 is connected to the battery adapter 39.

It can now be appreciated that, because the lower bracket member 38 with the attached battery adapter 39 can be readily removed from the light stand 10 and replaced with another lower bracket member 38 bearing a battery adapter 39 of a different kind, standard, brand, or style, the light stand 10 can be quickly adapted to receive a battery pack of a different "universal" mounting standard.

Figure 6A:
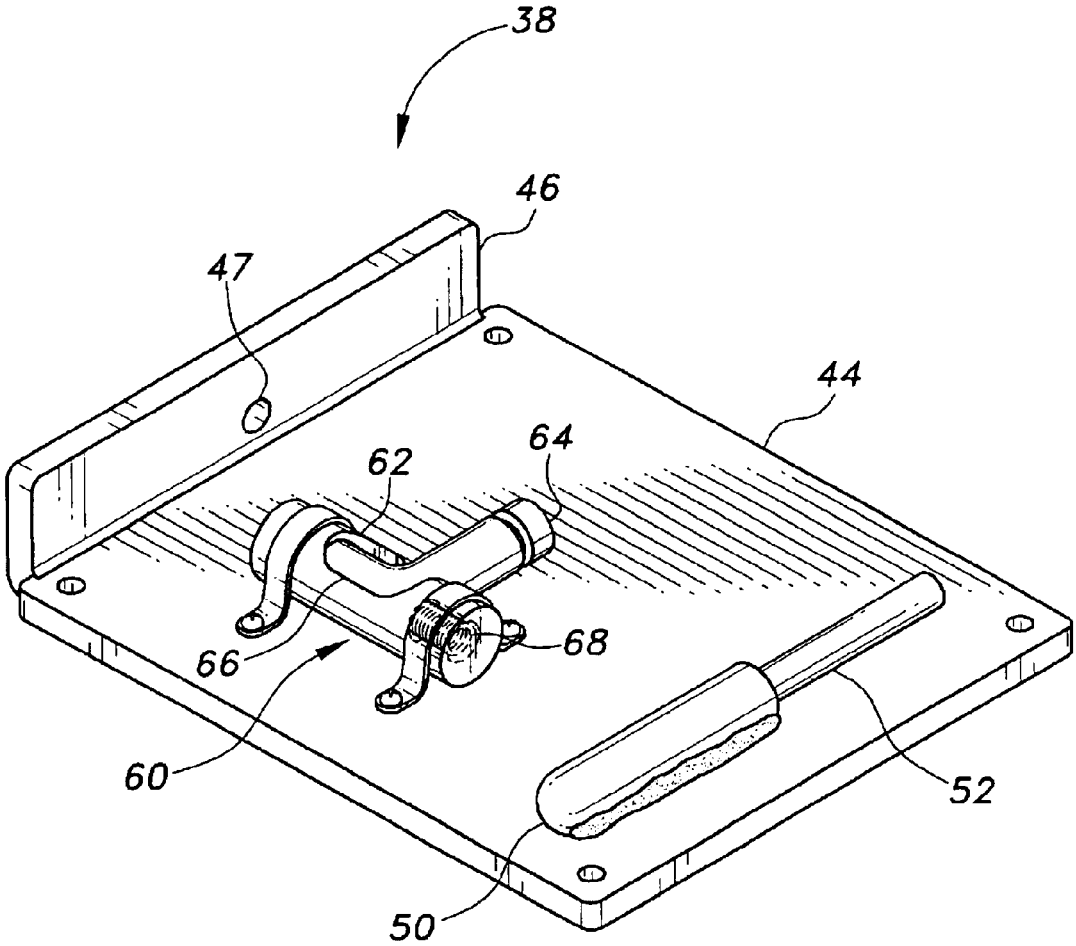
FIG. 6A is a perspective view of the lower bracket member of the light stand according to the present invention having a collapsible accessory adapter.
Figure 6B:
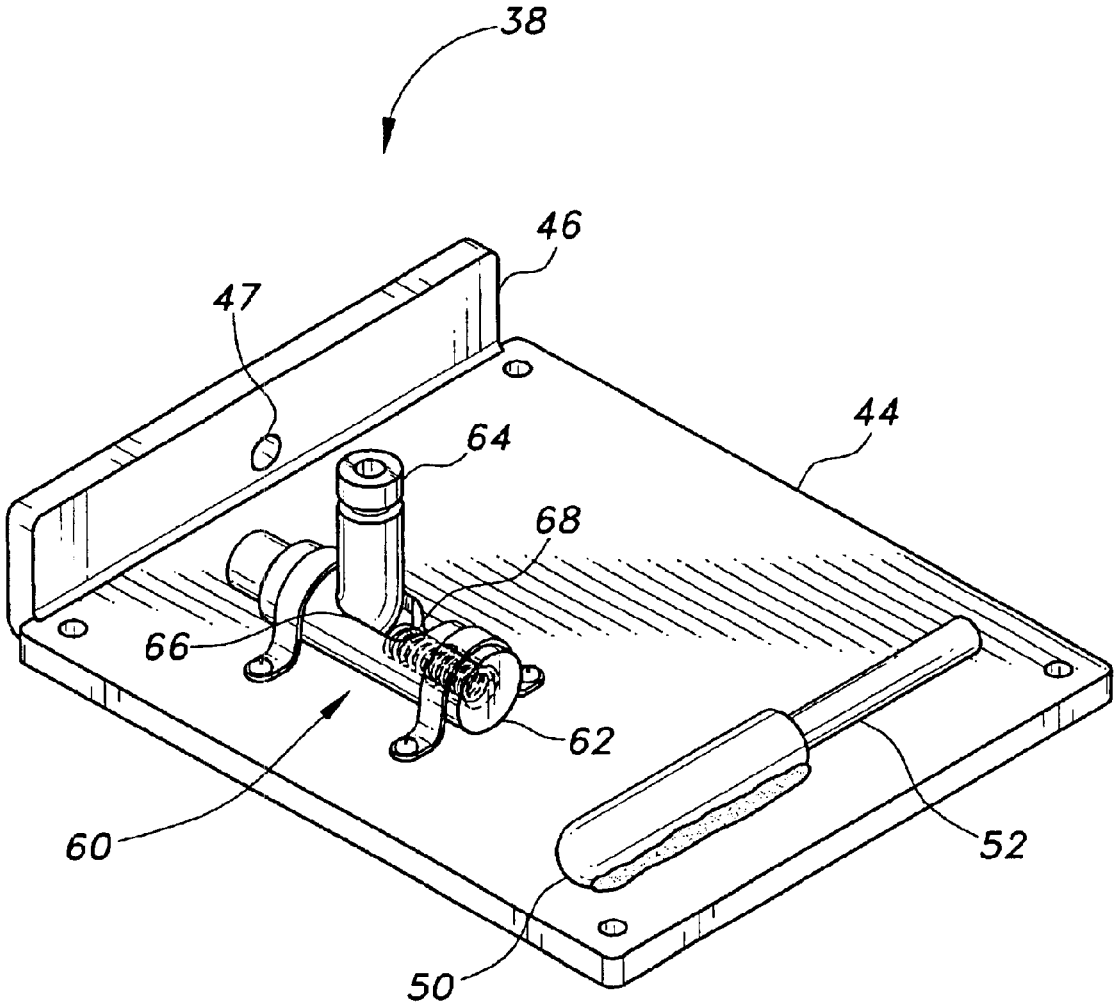
FIG. 6B is a perspective view of the lower bracket member of the light stand according to the present invention having a collapsible accessory adapter, shown in the extended position.

The lower bracket member 38 is additionally fitted with a collapsible accessory mounting fixture 60, seen in FIGS. 6A and 6B. The collapsible accessory mounting fixture 60 is extendable to receive a photographic lighting or other accessory directly on the lower bracket member 38, apart from the light stand 10. Thus, lower bracket member 38 may be removed from the light stand along with the battery adapter 39 and any battery pack attached thereto, and used along with a photographic lighting accessory, mounted on the collapsible accessory mounting fixture 60, as a remote or separate lighting source.

The collapsible accessory mounting fixture 60 illustrated in FIGS. 6A and 6B comprises an outer sleeve 62 and an "U" shaped post or "spud" adapter 64 having one end slidably disposed in the outer sleeve 62. A slot 66 is formed in the outer sleeve 62 that allows the "L" shaped post 64 to be laid flat, or stood upright. When the "L" shaped post 64 is stood upright in a vertical position, the "L" shaped post 64 is slidable within the outer sleeve 62 to a position where an upright portion of the "L" shaped post 64 is engaged with the slot 66 so that the slot 66 holds the "L" shaped post 64 in the upright position. A spring 68 biases the "L" shaped post 64 to retain the "L" shaped post 64 once put into the upright position.

Figure 7:
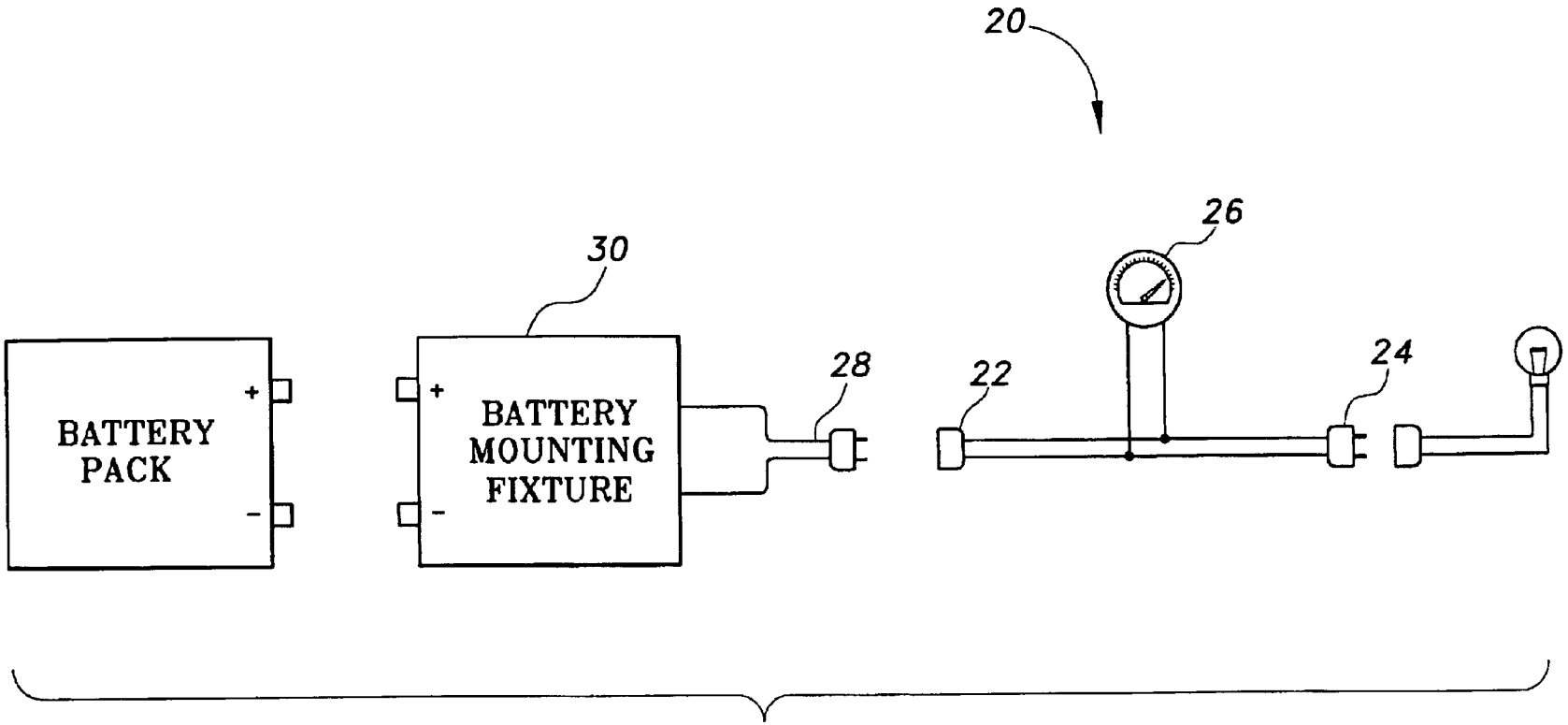
FIG. 7 is a schematic diagram showing connection of a battery pack to the wiring harness of the light stand according to the present invention.

As shown in FIG. 7, the light stand 10 includes a wiring harness 20 that connects from the battery wire 28 to the lighting or other accessory atop the light stand 10. A battery connector 22 is provided for connection to the battery wiring 28. An accessory connector 24 is provided for connection to any lighting or other accessory mounted atop the light stand 10. The wiring harness 20 includes a voltmeter 26. The voltmeter 26 provides an indication of the charge state of the battery pack. The wiring harness is disposed in a coiled fashion around the telescoping vertical support post 12.

It is to be understood that the present invention is not limited to the embodiments described above, but encompasses any and all embodiments within the scope of the following claims.

I claim:

1. A light stand, comprising:

a teescoping vertical support post having top and bottom ends;

a plurality of collapsible legs disposed near the bottom end of said telescoping vertical support post, the legs being extendable below the bottom end of said telescoping vertical support post;

an accessory mounting fixture disposed on the top end of said telescoping vertical support post; and a battery mounting fixture disposed on the bottom end of said telescoping vertical support post, said battery mounting fixture comprising a bracket assembly having a bottom portion and mounted to the bottom end of said telescoping vertical support post and a battery adapter and mounted to the bottom portion of said bracket assembly.

2. The light stand according to claim 1, further comprising a wiring harness disposed on said telescoping vertical support post, the wiring harness comprising at least one length of wire for electrically connecting a battery mounted on said battery mounting fixture to an electrical accessory mounted on said accessory mounting fixture.

3. The light stand according to claim 2, wherein said wiring harness is coiled around said telescoping vertical support post.

4. The light stand according to claim 2, wherein said wiring harness further comprising:

a voltmeter;

a first length of wire having a first end connected to said voltmeter and a second end adapted for connection to a battery mounted on said battery mounting fixture; and a second length of wire having a first end connected to said voltmeter and a second end adapted for connection to an electrical accessory mounted on said accessory mounting fixture.

5. The light stand according to claim 1, wherein said bracket assembly comprises:

an upper bracket member; and a lower bracket member hingeably and removably mounted to said upper bracket member.

6. The light stand according to claim 5, further comprising a collapsible accessory mounting fixture disposed on said lower bracket member.

* * * * *